US009486091B2

(12) United States Patent
Joscher et al.

(10) Patent No.: US 9,486,091 B2
(45) Date of Patent: Nov. 8, 2016

(54) MOVING RAIL HANGER

(76) Inventors: Allen Joscher, Prior Lake, MN (US); Amy Joscher, Burnsville, MN (US); Kurt Joscher, Burnsville, MN (US)

( * ) Notice: Subject to any disclaimer, the term of this patent is extended or adjusted under 35 U.S.C. 154(b) by 952 days.

(21) Appl. No.: 12/786,023

(22) Filed: May 24, 2010

(65) Prior Publication Data

US 2011/0284483 A1 Nov. 24, 2011

(51) Int. Cl.

| | |
|---|---|
| ***G09F 19/02*** | (2006.01) |
| ***A47F 5/025*** | (2006.01) |
| ***A47F 5/08*** | (2006.01) |
| ***A47G 33/08*** | (2006.01) |

(52) U.S. Cl.

CPC ..... *A47F 5/025* (2013.01); *A47F 5/0838* (2013.01); *A47G 33/0809* (2013.01); *A47G 33/0818* (2013.01); *A47G 2033/0827* (2013.01); *G09F 19/02* (2013.01)

(58) Field of Classification Search

CPC ..... G09F 19/02
USPC ..... 40/430
See application file for complete search history.

(56) References Cited

U.S. PATENT DOCUMENTS

| | | | | |
|---|---|---|---|---|
| 4,344,243 | A * | 8/1982 | Reszka | 40/415 |
| 5,211,366 | A * | 5/1993 | Cummings | 248/230.8 |
| 5,450,682 | A * | 9/1995 | Franco et al. | 40/415 |
| 5,577,448 | A * | 11/1996 | Leung | 104/53 |
| 5,632,107 | A * | 5/1997 | Meng-Suen et al. | 40/430 |
| 6,152,800 | A * | 11/2000 | Higuchi | 446/444 |
| 6,276,280 | B1 * | 8/2001 | Nitti | 104/124 |
| 6,638,135 | B2 * | 10/2003 | Fong | 446/242 |
| 7,610,704 | B1 * | 11/2009 | Nowicki | 40/435 |
| 2002/0112382 | A1 * | 8/2002 | Butcher | 40/406 |

* cited by examiner

*Primary Examiner* — Gary Hoge
(74) *Attorney, Agent, or Firm* — Berggen Law Office, LLC; William R. Berggren; Stephen F. Wolf

(57) ABSTRACT

The moving rail hanger comprises: a) a rail; b) a plurality of hanger brackets, each of said hanger brackets moveably and detachably attached to said rail, and each of said hanger brackets detachably attached to an external support structure, at one or more of said hanger brackets further comprising a drive mechanism said drive mechanism said rail along a path of movement defined by said plurality of hanger brackets; and c) one or more display brackets immovably and detachably attached to said rail.

20 Claims, 17 Drawing Sheets

MOVING RAIL HANGER

BACKGROUND OF THE INVENTION

1. Field of the Invention

This invention pertains to the field ornamental display systems.

2. Description of Related Art

The desire to attract attention to items placed on display by imparting motion to the items is a long standing goal. One approach to reaching this goal is to support the displayed object by means of a moving cart which follows a track. The utility patents to Nitti (U.S. Pat. No. 6,276,280B1), Higuchi (U.S. Pat. No. 6,152,800A), Cummins (U.S. Pat. No. 5,211,366A), Leung (U.S. Pat. No. DE4,445,708A1), and Franco, et al (U.S. Pat. No. 5,450,628A) are exemplary of such an approach.

Another approach is to place the entire display assembly including both an ornamental sculpture and objects to be displayed upon a base and set the ornamental structure in motion. The utility patent to Jack M. Jonas (U.S. Pat. No. 5,664,351A), and the design patent to Russo, (U.S. Pat. No. D349,471S1) are exemplary of this approach.

Yet another approach is to place the items to be displayed on a moving (usually rotating) stand having most of the stand concealed by the decorative sculpture, such as a Christmas Tree. The utility patents to Leung (U.S. Pat. No. 5,577,448A), Segan et al (U.S. Pat. No. 5,550,319), Stanley (U.S. Pat. No. 3,233,090), Gamble (U.S. Pat. No. 2,765,583A), McNeight, (Patent No. GB2209309A), and Yang (U.S. Pat. No. 5,393,578A) are exemplary of such devices.

Another approach is to place the objects to be displayed in a stationary track and cause the objects to be moved along the track. The patent to Segan, Mark H. et al (U.S. Pat. No. 5,279,871A) is exemplary of this approach.

BRIEF SUMMARY OF THE INVENTION

The moving rail hanger is a device for displaying objects, on an external support structure, often a decorative item, such as a Christmas Tree, Sports Display, Diorama or other item of interest to observers, where movement of the objects for display relative to the external support structure is desired. The moving rail hanger is placed on the external support structure or on a base shared with the external support structure or a base in close proximity to the external support structure. When in operation at least one of the hanger brackets imparts motion to the rail through frictional contact of pinch rollers, a gear drive, or other suitable means. One implementation of the gear drive is a rack-and-pinion in which the rail forms a rack and a gear in the hanger bracket forms a pinion gear. The moving rail supports one or more objects for display by means of the display brackets attached to the rail and thereby causing motion of the objects for display as the rail moves. The moving rail may be constructed of any material which is flexible enough to accommodate movement of the moving rail through the path of movement of the moving rail yet strong enough to support the various display brackets as the rail and display brackets move along the path of movement of the moving rail hanger. Such materials include but are not limited to wood, plastic, and metal. The path of movement is defined by the placement of the hanger brackets and the flexibility of the rail. The rail of the moving rail hanger may form a continuous loop. The rail may also not form a continuous loop. The motion of the rail may be forward, or backward, or a combination of forward and backward motion along the path of movement defined by the rail and hanger brackets.

BRIEF DESCRIPTION OF THE SEVERAL VIEWS OF THE DRAWING

FIG. 15A2 is a section view of a normally closed magnetic sensor with logic board activated open.

FIG. 15B1 is a section view of a normally open magnetic sensor with logic board.

FIG. 15B2 is a section view of a normally open magnetic sensor with logic board activated closed.

DETAILED DESCRIPTION OF THE INVENTION

Figure 1:
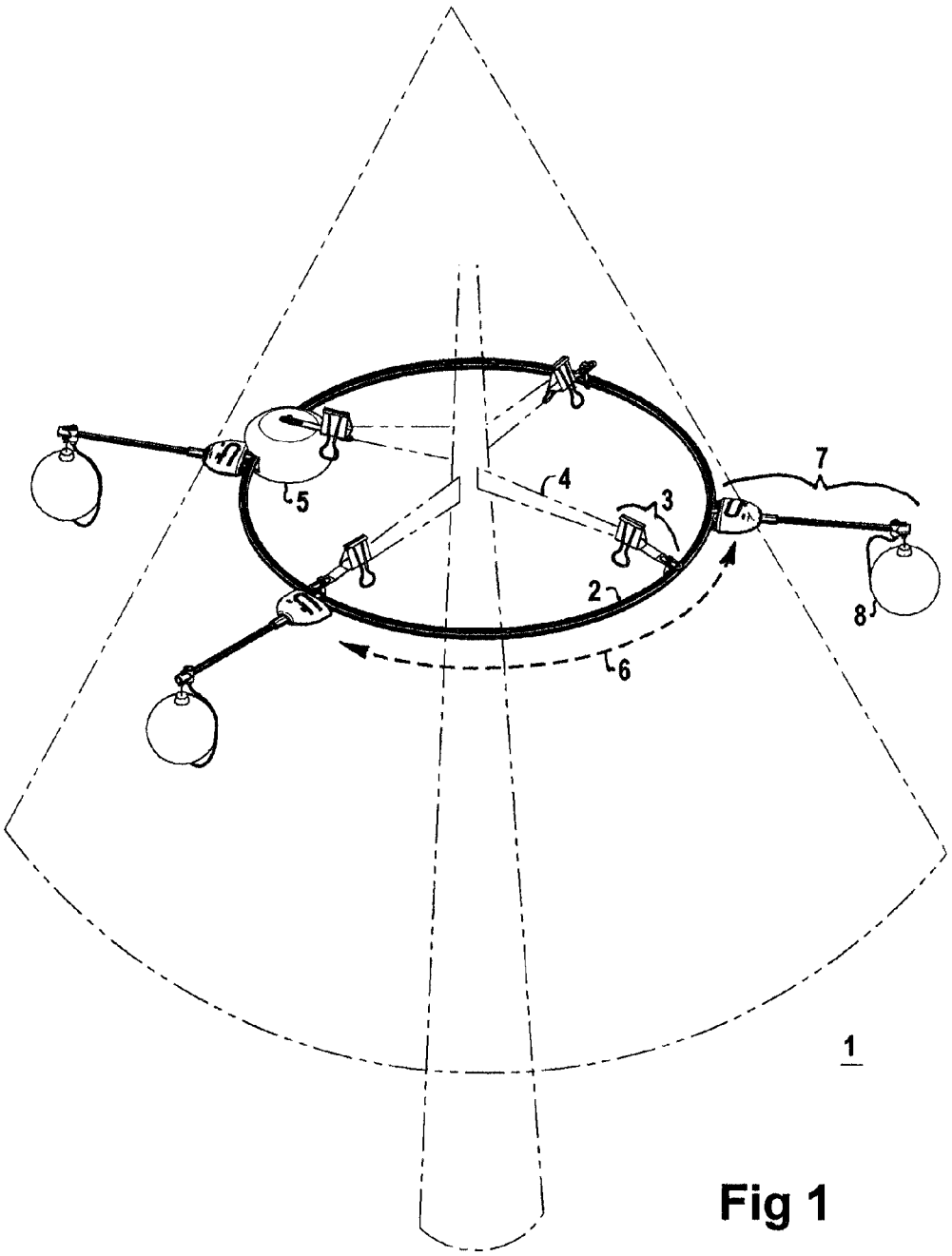
FIG. 1 is a perspective view of moving rail hanger mounted on a tree shown in broken lines.
Figure 2:
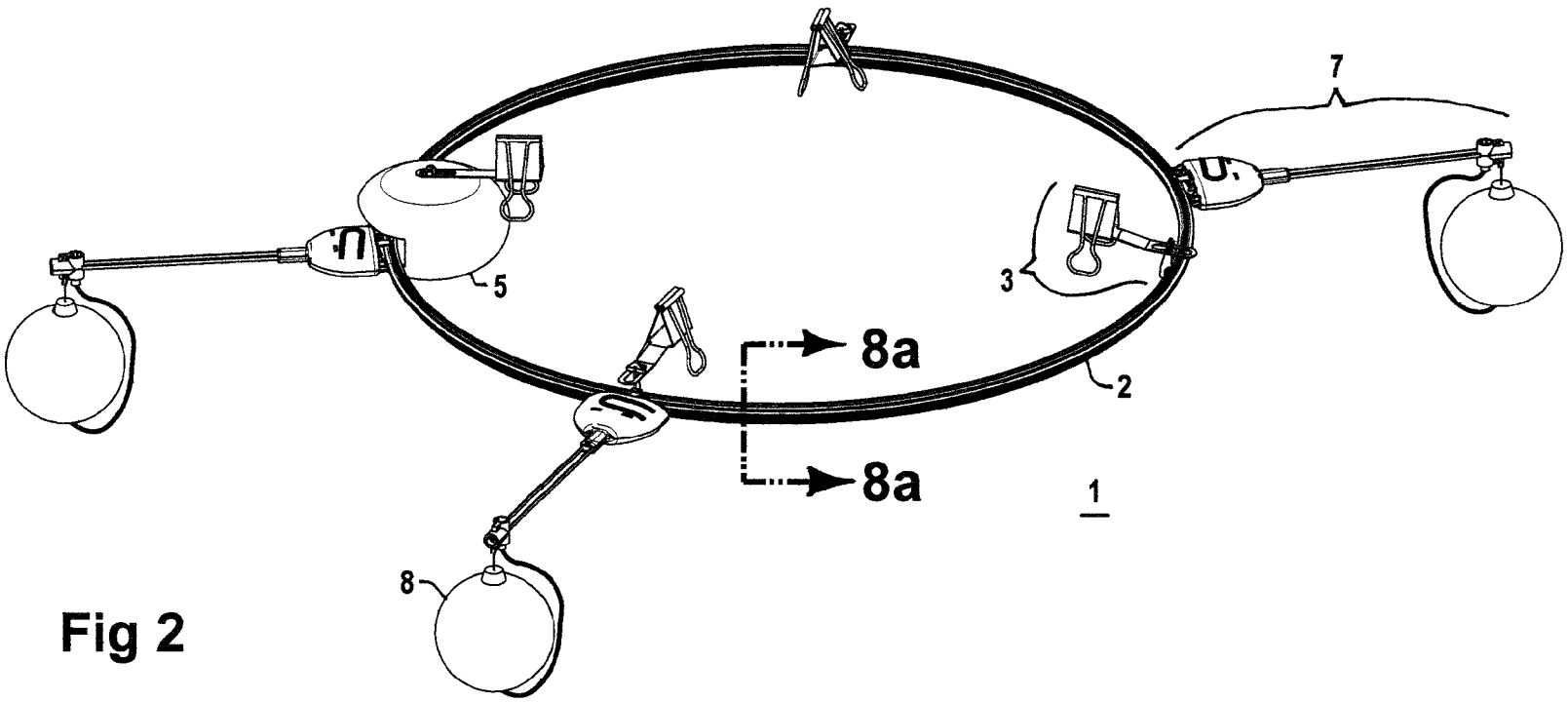
FIG. 2 is a perspective view of moving rail hanger.
Figure 3:
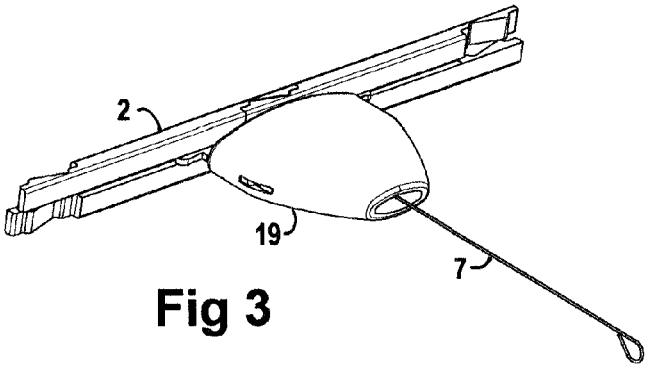
FIG. 3 is a perspective view of a rail and display bracket.
Figure 4:
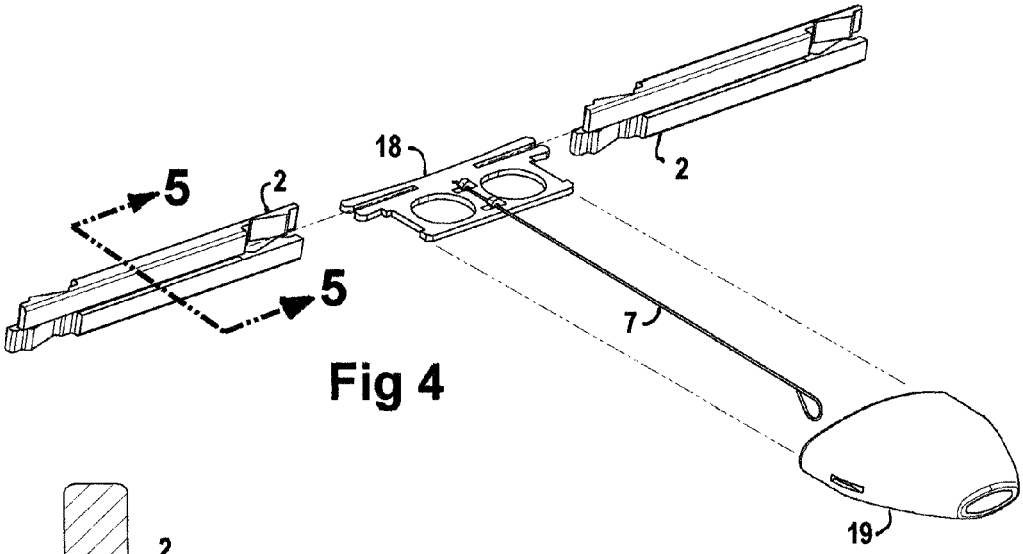
FIG. 4 is an exploded view of a rail and display bracket with coupling.
Figure 5:
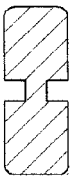
FIG. 5 is a cross section view of an embodiment of a rail.
Figure 4A:
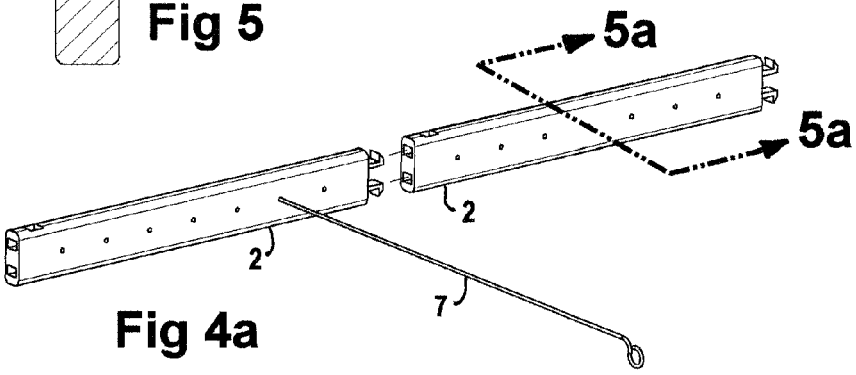
FIG. 4A is an exploded view of a rail and display bracket without coupling.
Figure 5A:
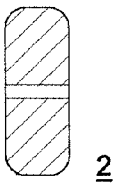
FIG. 5A is a cross section view of an embodiment of a rail.
Figure 6:
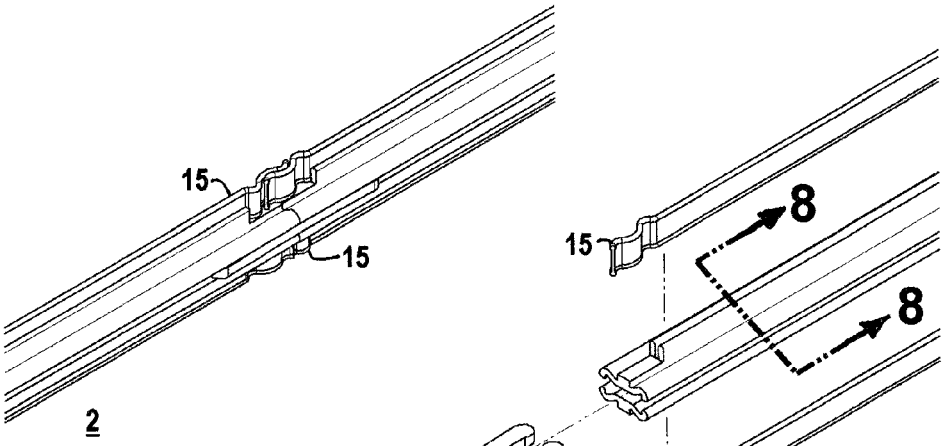
FIG. 6 is a perspective view of an assembled rail with electrical conductors.
Figure 7:
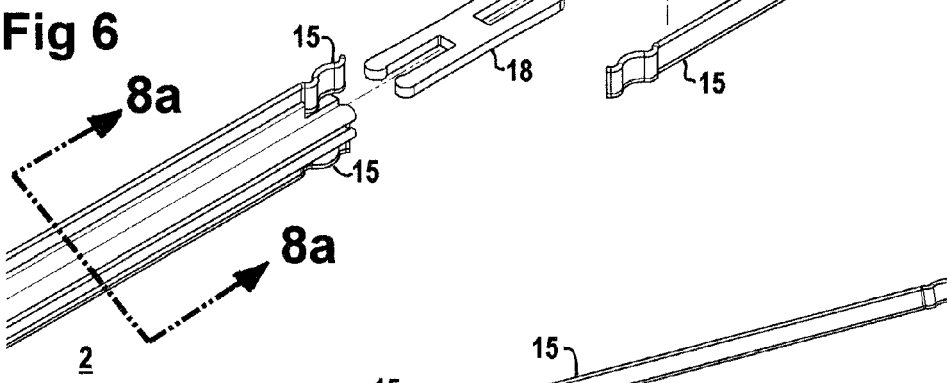
FIG. 7 is an exploded view of a rail with electrical conductors and alternative coupling.
Figure 7A:
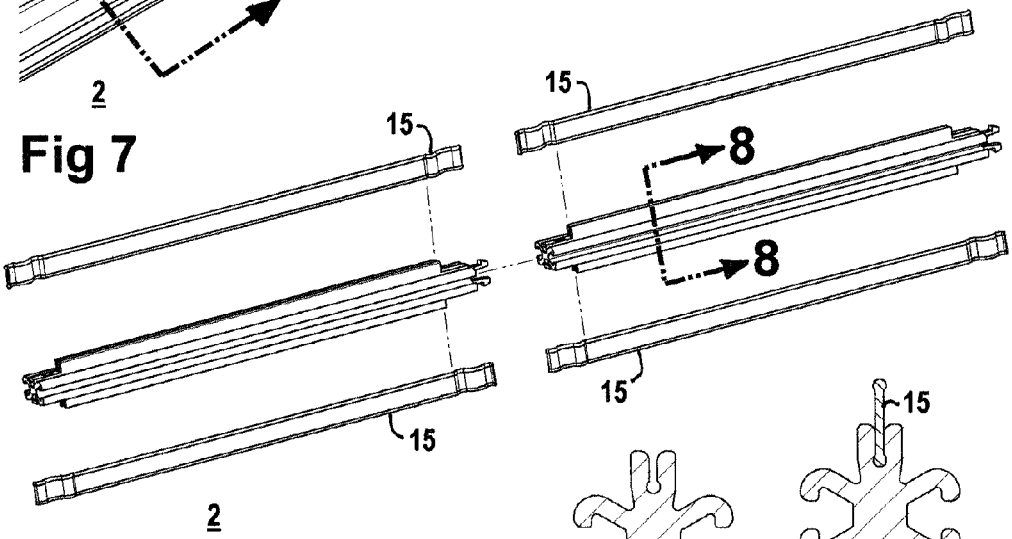
FIG. 7A is a exploded view of a rail with electrical conductors without coupling.
Figure 8:
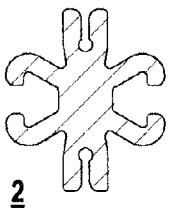
FIG. 8 is a cross section view of a rail without electrical conductors.
Figure 8A:
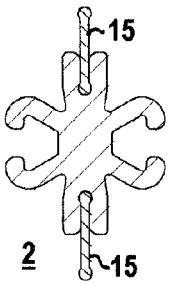
FIG. 8A is a cross section view of a rail with electrical conductors.
Figure 9:
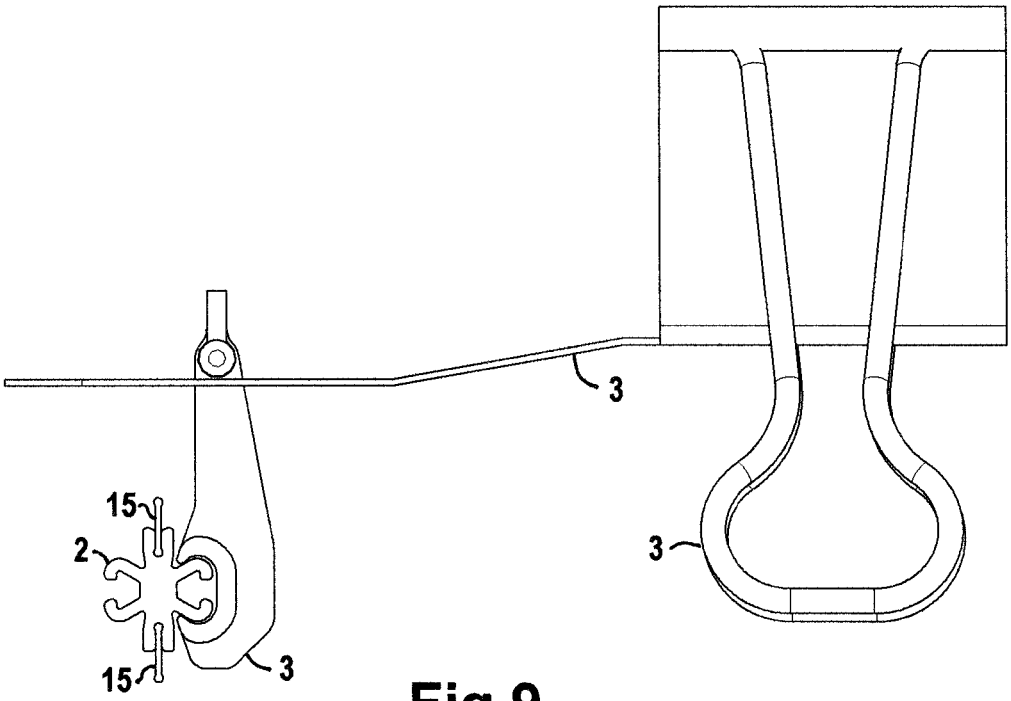
FIG. 9 is a side view of hanger bracket and a rail assembly.
Figure 10:
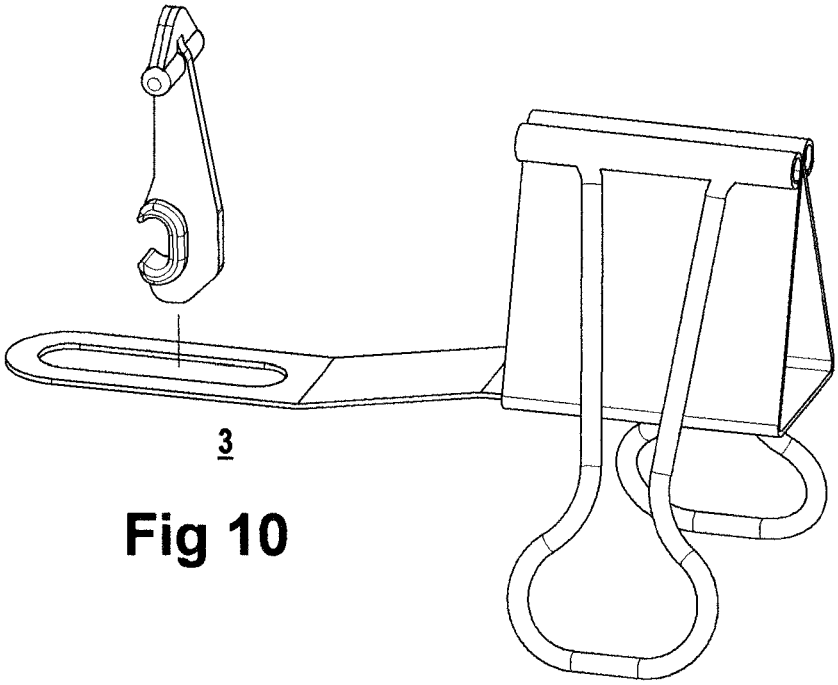
FIG. 10 is an exploded view of an embodiment of a hanger bracket.
Figure 11:
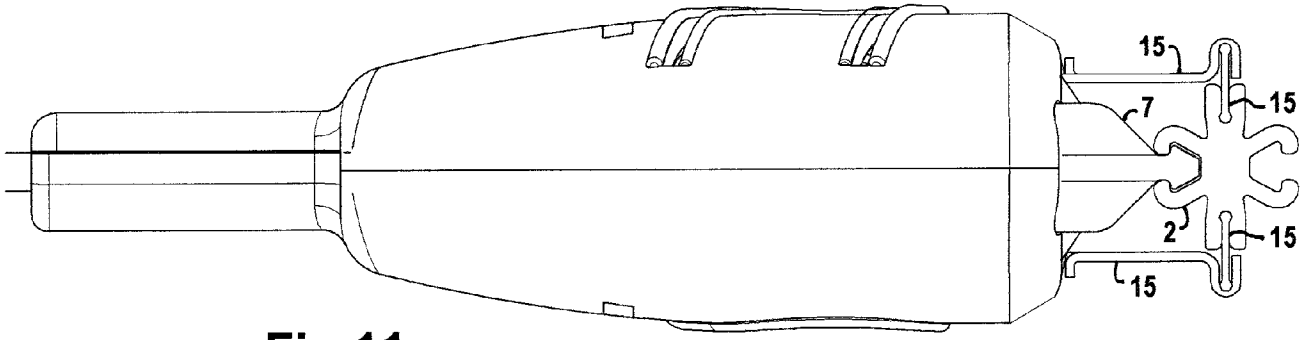
FIG. 11 is a side view of a display bracket with electrical conductive rail.
Figure 12:
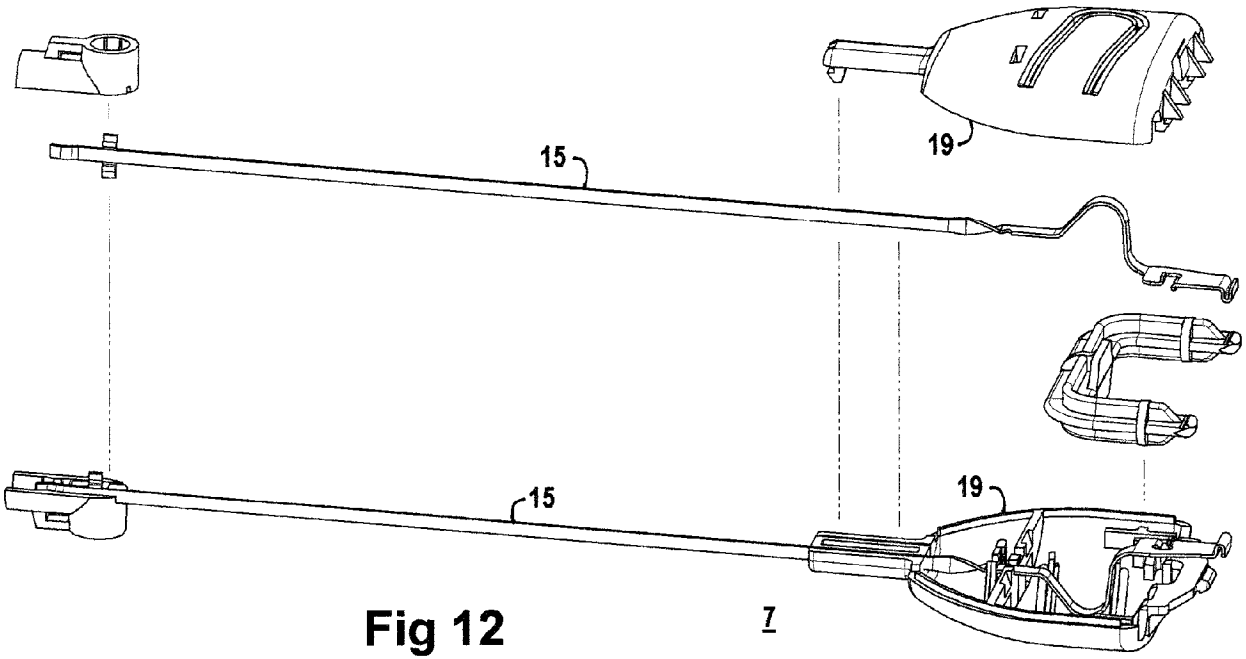
FIG. 12 is an exploded view of a display bracket.
Figure 13:
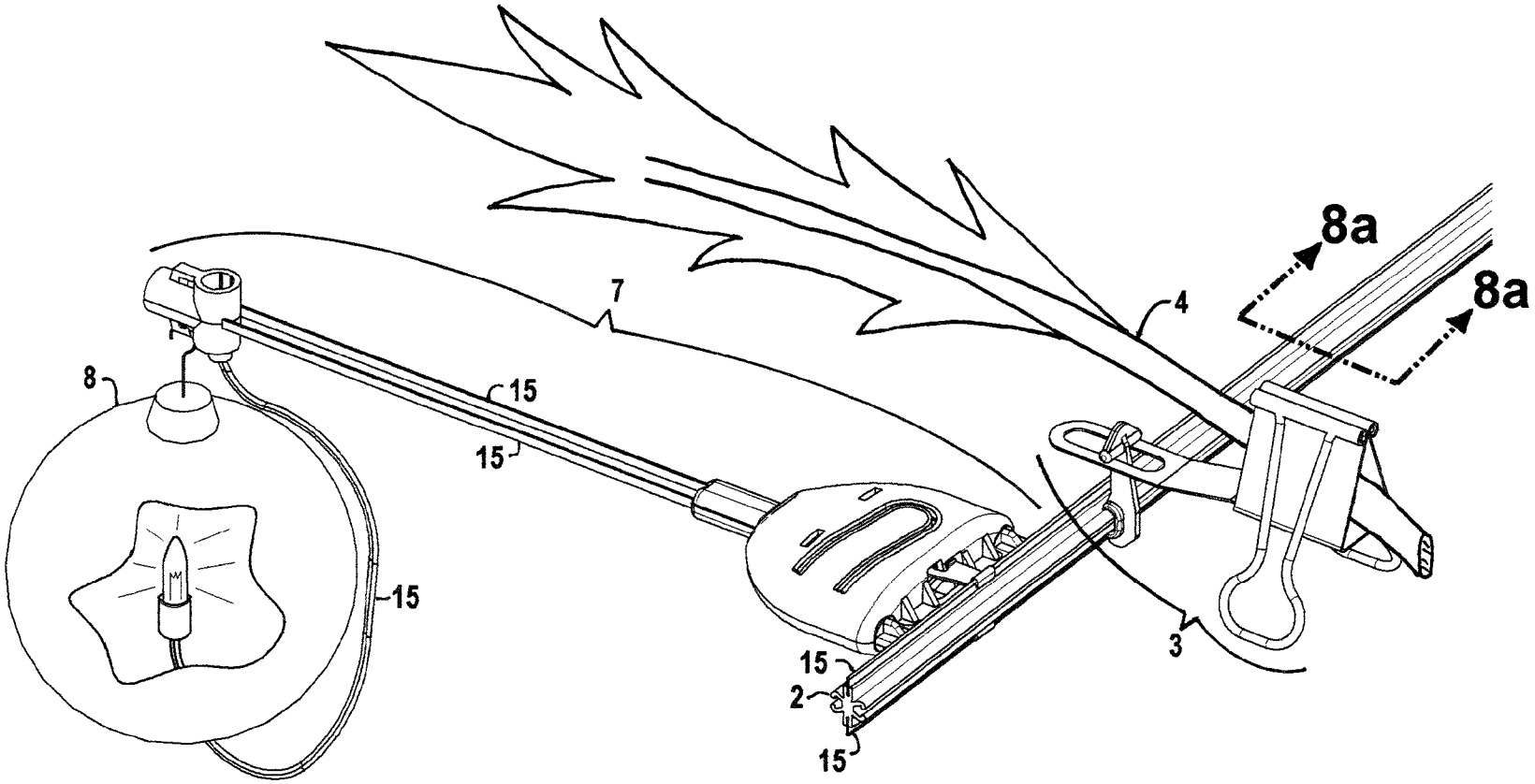
FIG. 13 is a perspective view of a rail with hanger bracket, display bracket and object for display.
Figure 14:
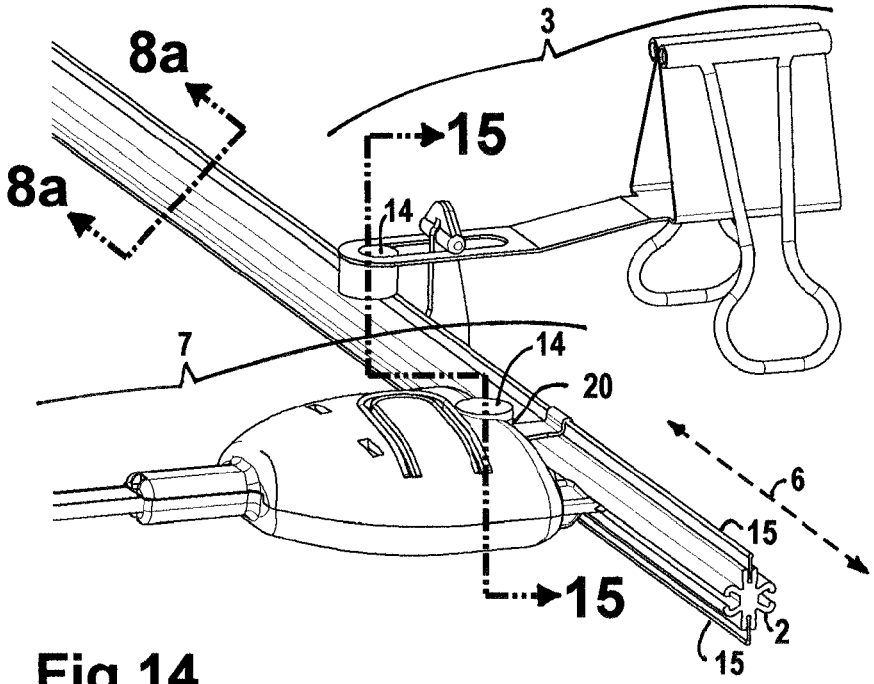
FIG. 14 is a perspective view of a rail with hanger bracket and display bracket with sensor.
Figure 14A:
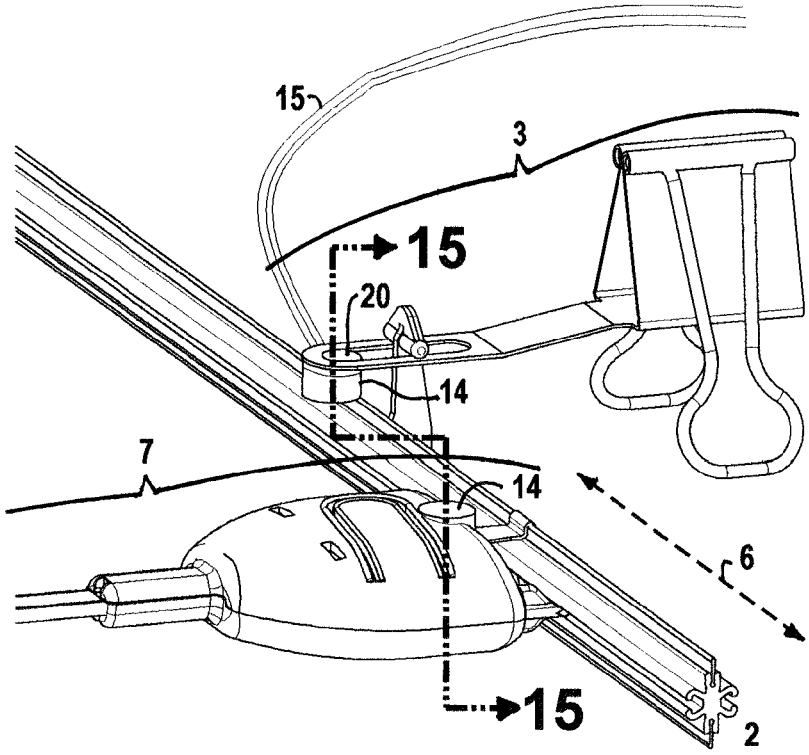
FIG. 14A is a perspective view of a rail with hanger bracket and display bracket with alternative sensor embodiment.
Figure 15:
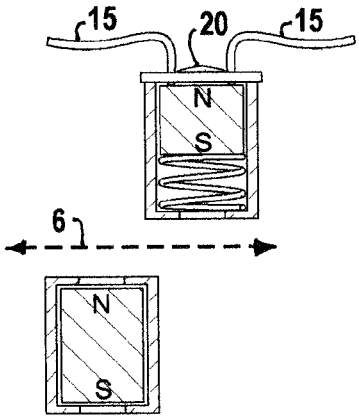
FIG. 15 is a section view of a normally closed magnetic sensor with logic board.
Figure 15C:
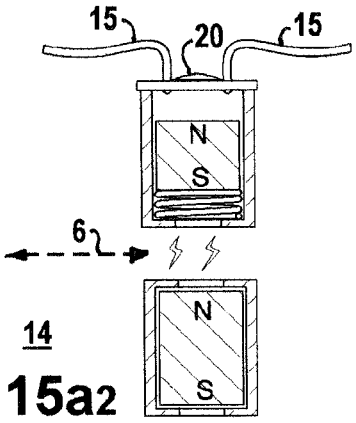
FIG. 15C is a perspective view of an optical sensor and logic board.
Figure 15C:
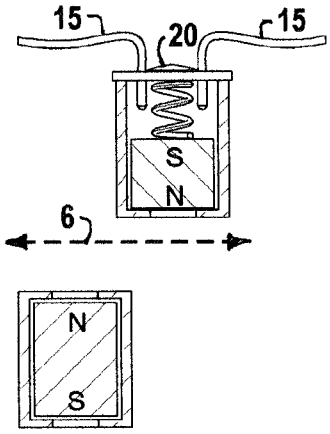
Figure 15C:
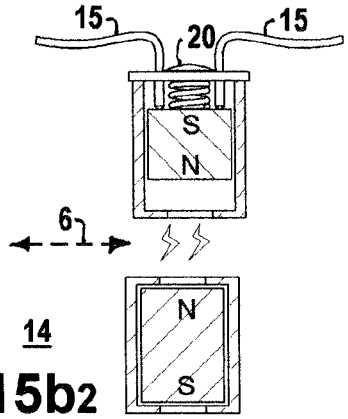
Figure 15C:
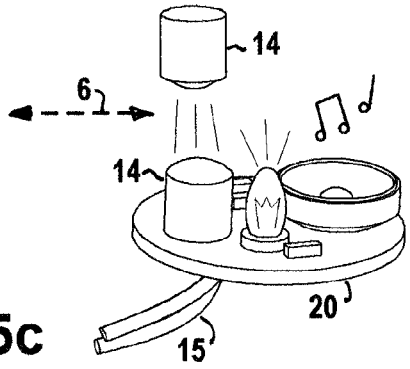
Figure 16:
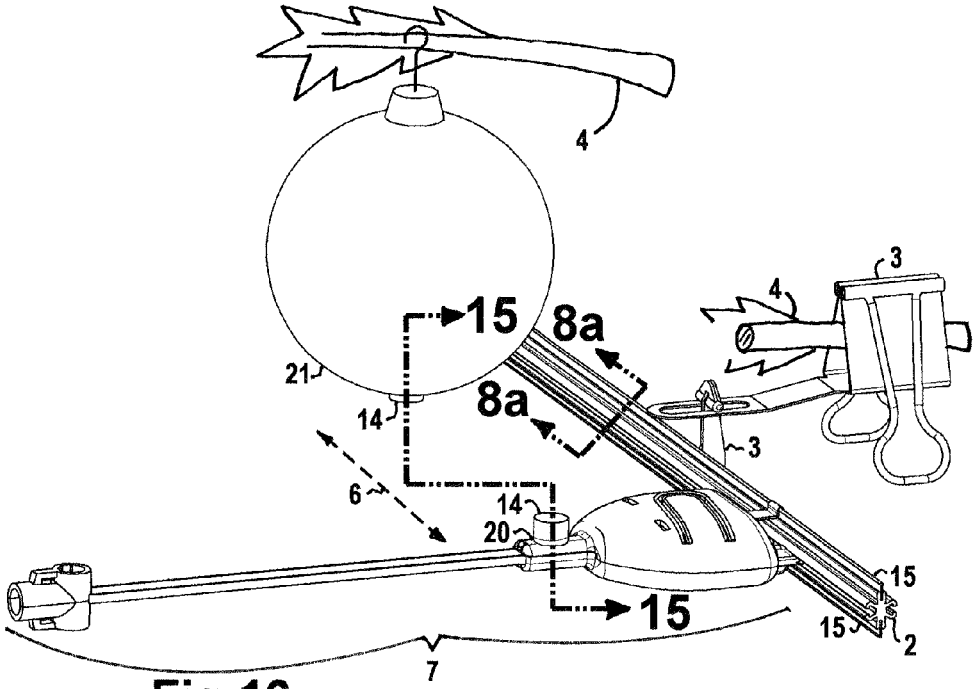
FIG. 16 is a perspective view of a rail with display bracket and static object for display with sensor.
Figure 16A:
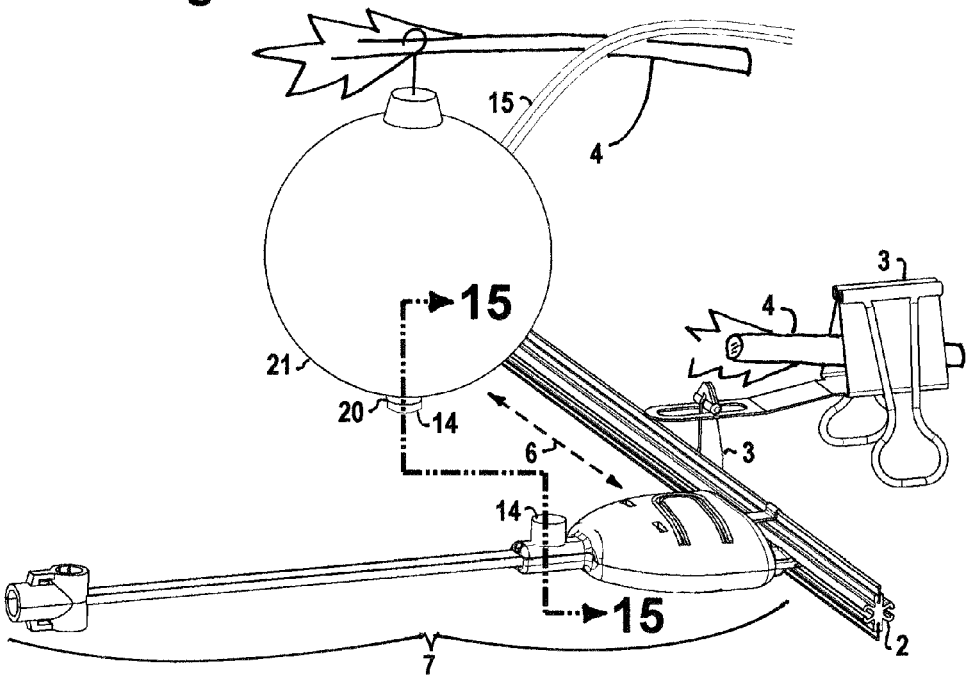
FIG. 16A is a perspective view of a rail with display bracket and static object for display with alternative sensor embodiment.
Figure 17:
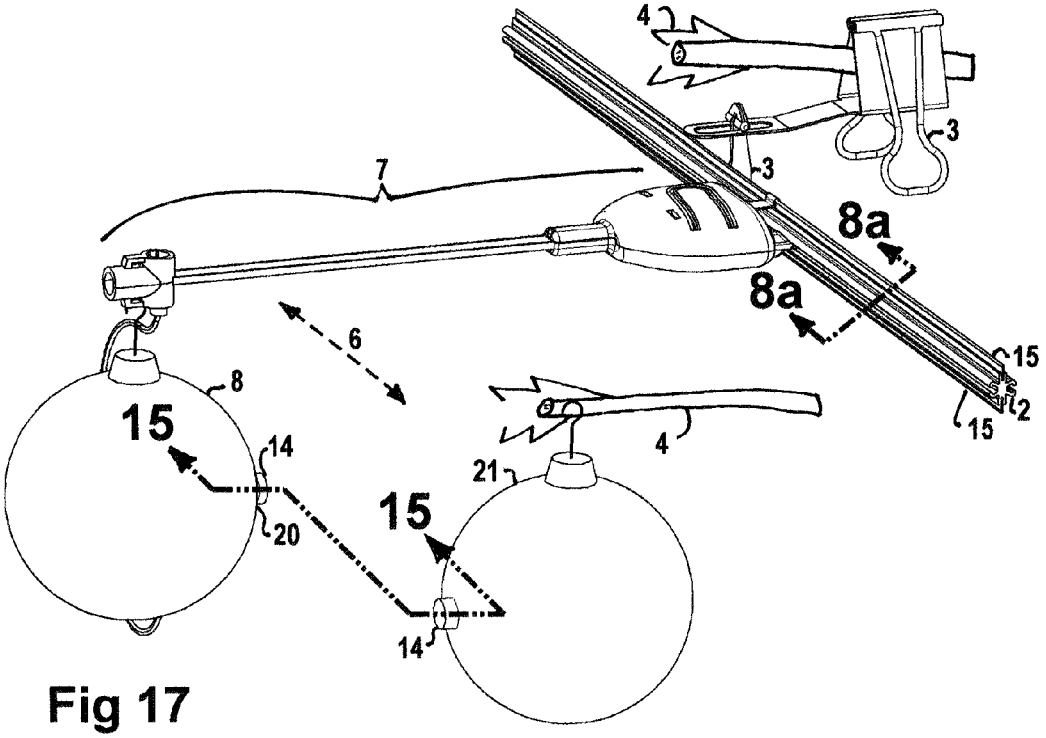
FIG. 17 is a perspective view of a rail with kinetic object for display and static object for display with sensor.
Figure 17A:
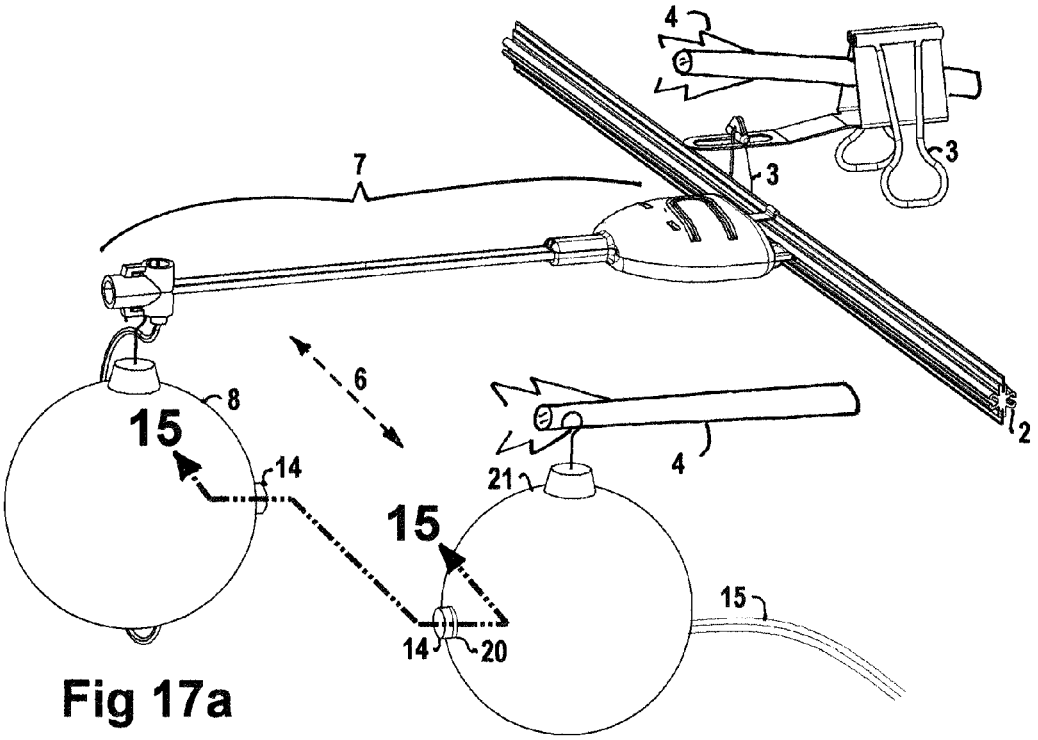
FIG. 17A is a perspective view of a rail with kinetic object for display and static object for display with alternative sensor embodiment.
Figure 18:
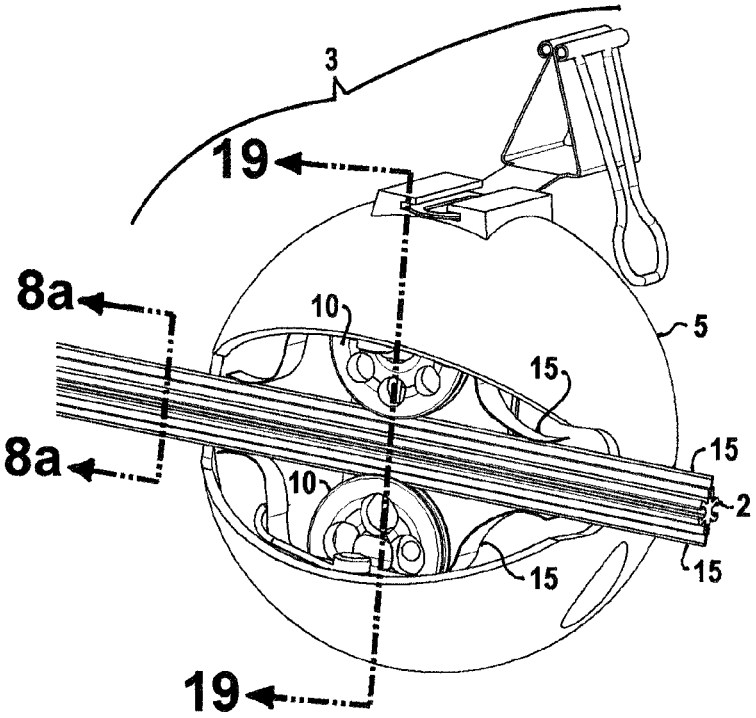
FIG. 18 is a perspective view of a hanger bracket with drive mechanism (pinch roller and a rail).
Figure 19:
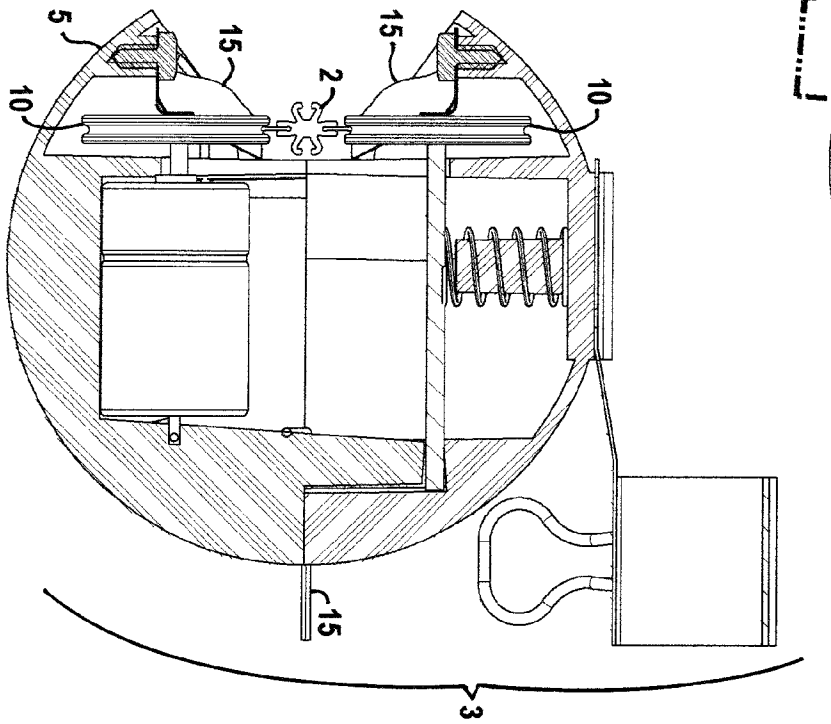
FIG. 19 is a section view of hanger bracket with drive mechanism (pinch roller and a rail).
Figure 20:
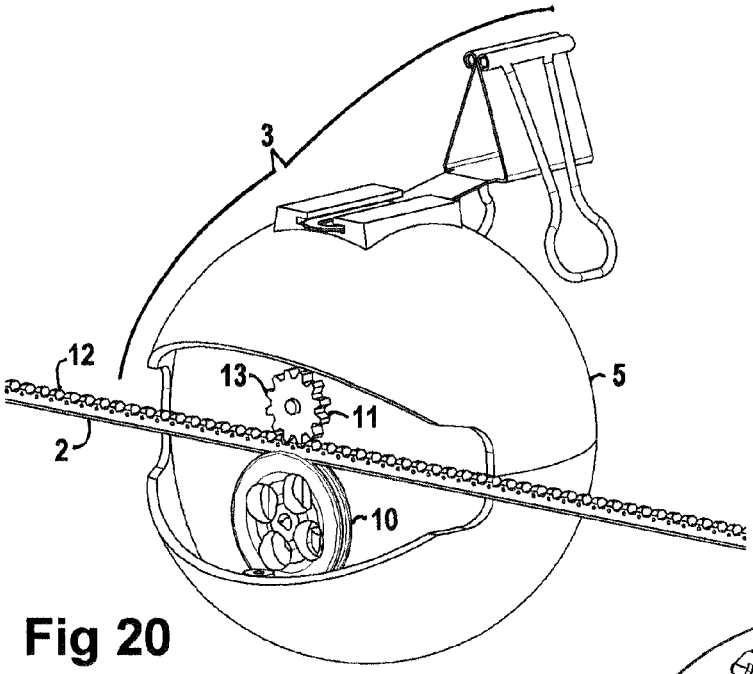
FIG. 20 is a perspective view of a hanger bracket with drive mechanism (rack and pinion) and a rail.
Figure 21:
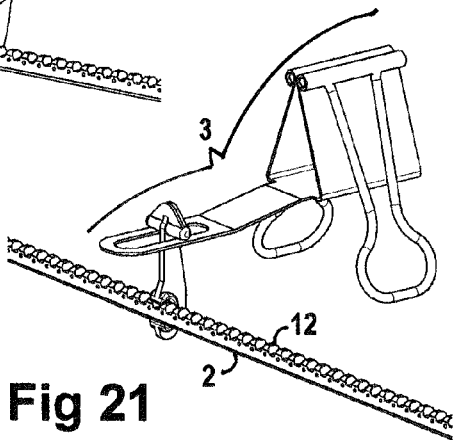
FIG. 21 is a perspective view of hanger bracket with a rail (rack embodiment).
Figure 22:
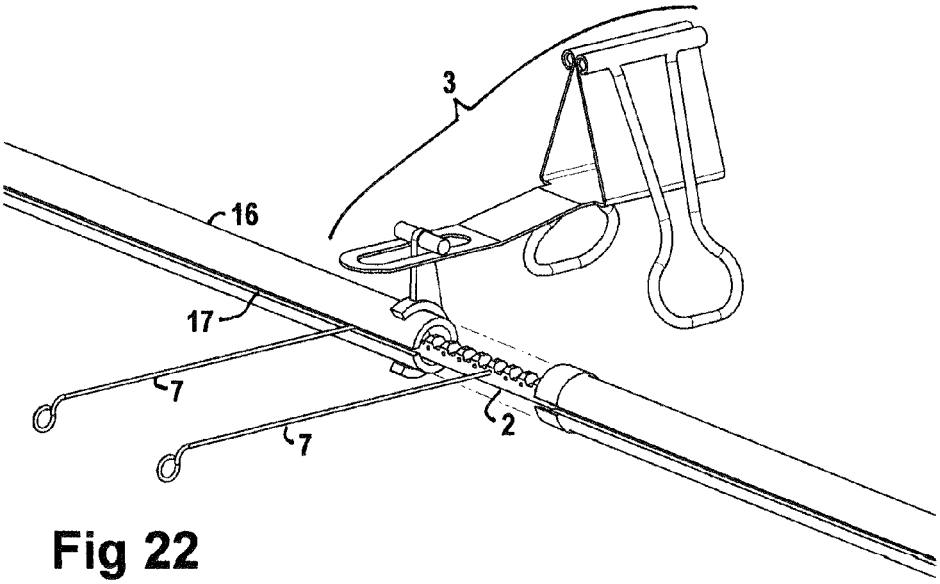
FIG. 22 is a perspective view of hanger bracket with a rail (rack embodiment) with case.
Figure 23:
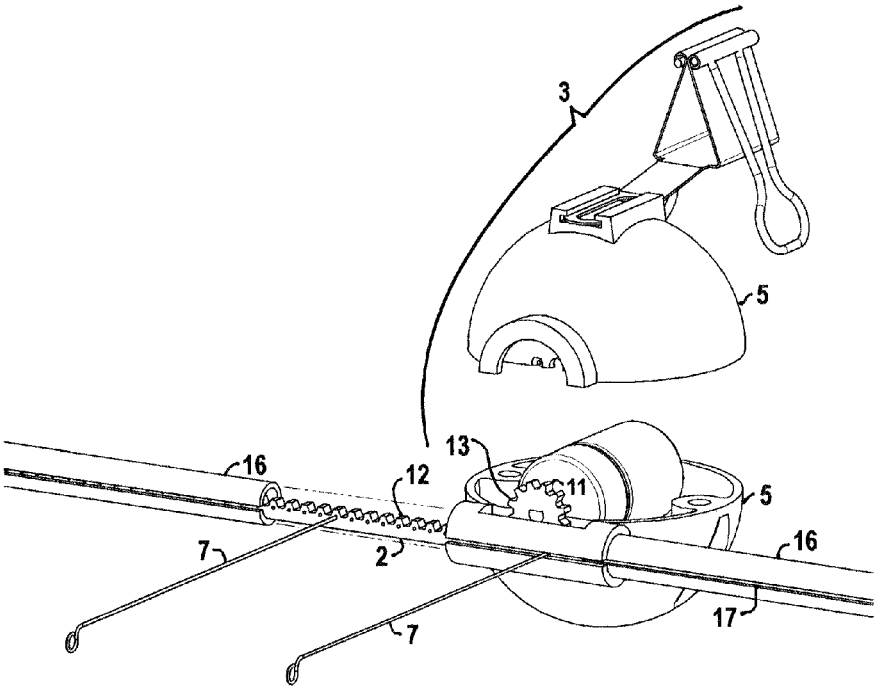
FIG. 23 is a perspective view of a hanger bracket with drive mechanism (rack and pinion) and a rail with case.
Figure 24:
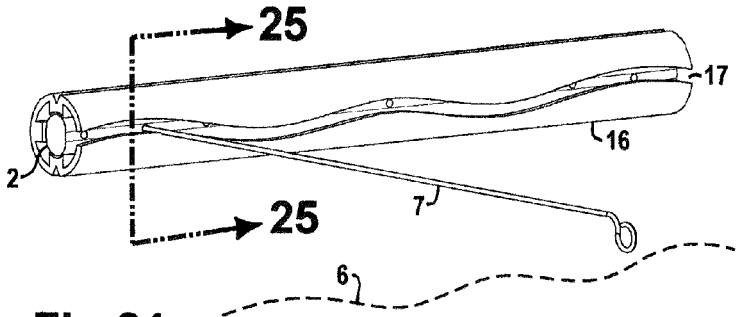
FIG. 24 is a perspective view of a portion of incased rail with slot configured to impart radial motion of display bracket.
Figure 25:
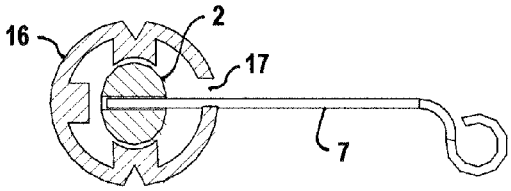
FIG. 25 is a sectional view of incased rail with slot configured to impart radial motion of display bracket.
Figure 26:
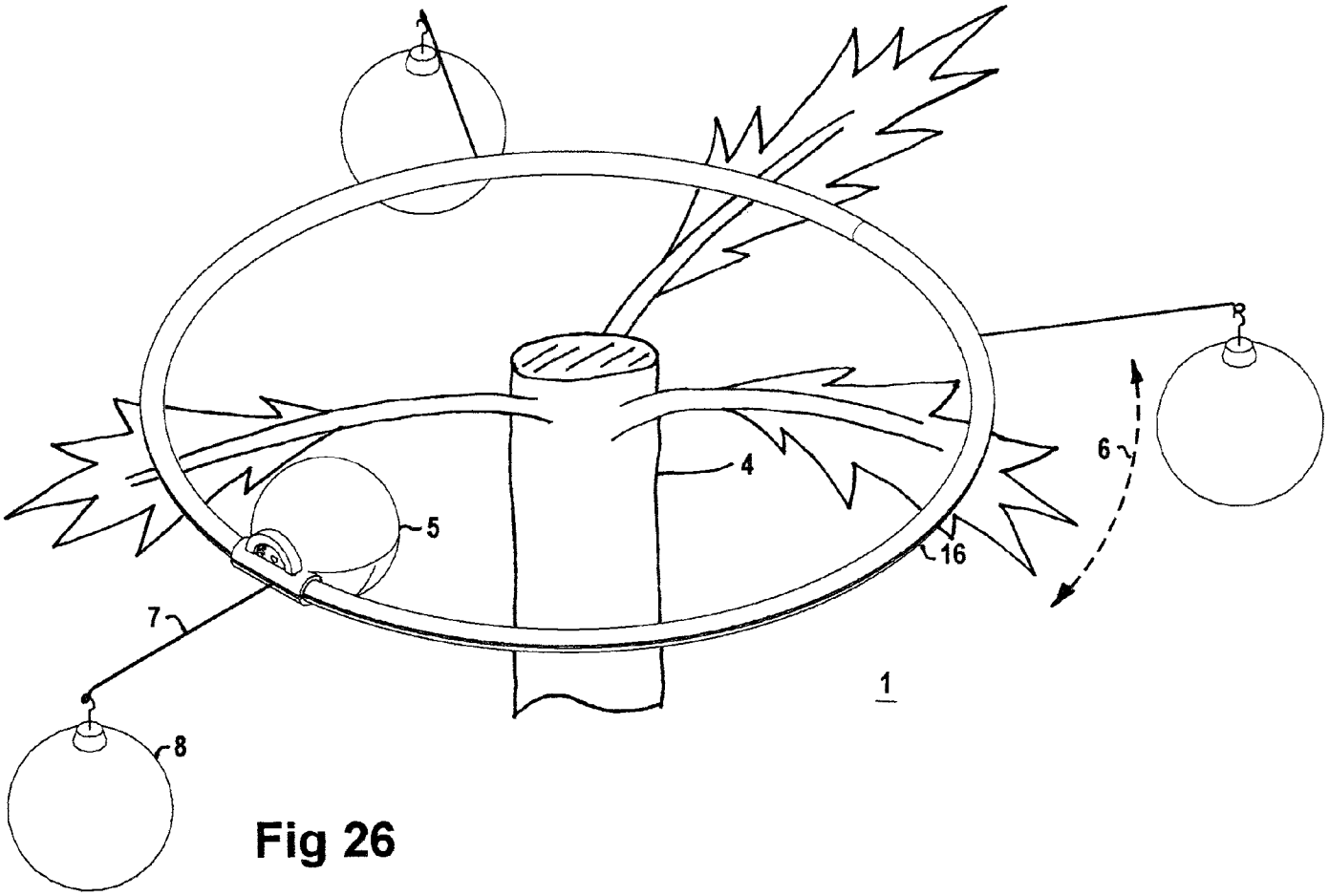
FIG. 26 is a perspective view of moving rail hanger without hanger bracket.
Figure 27:
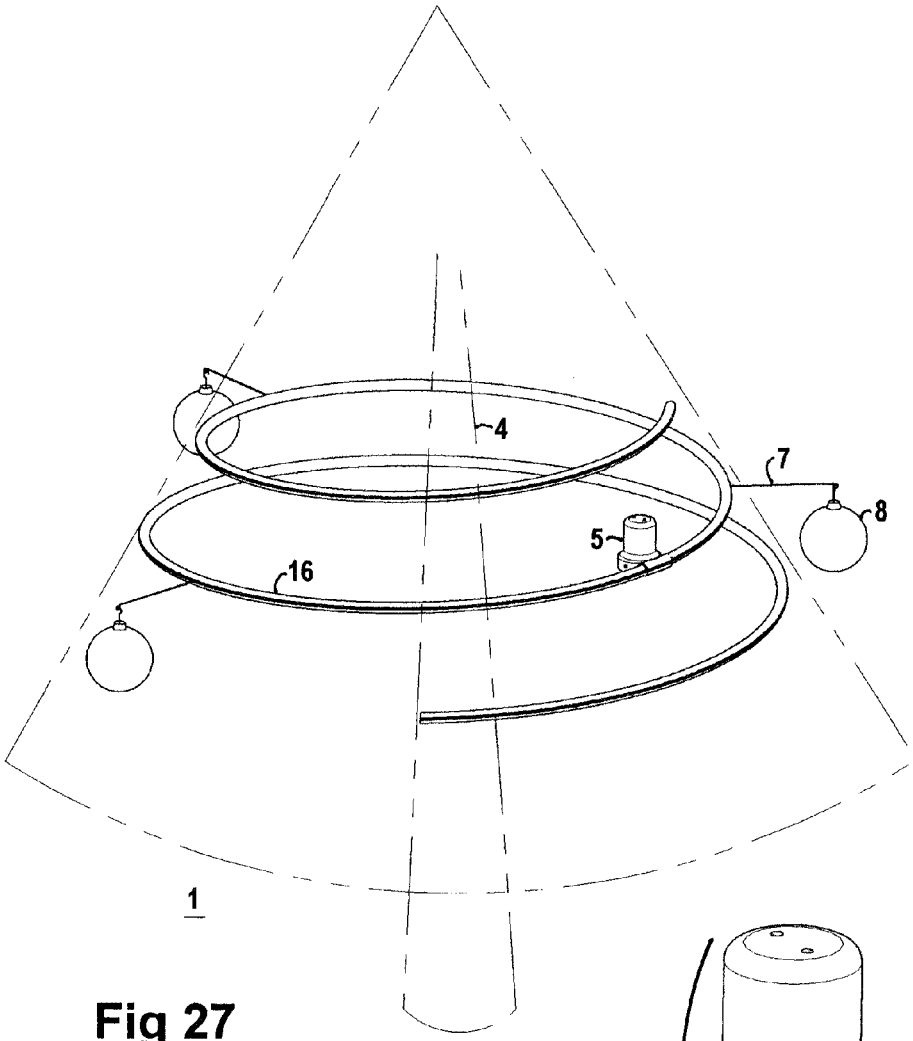
FIG. 27 is a perspective view of moving rail hanger in a non-continuous loop configuration mounted on a tree shown in broken lines.
Figure 28:
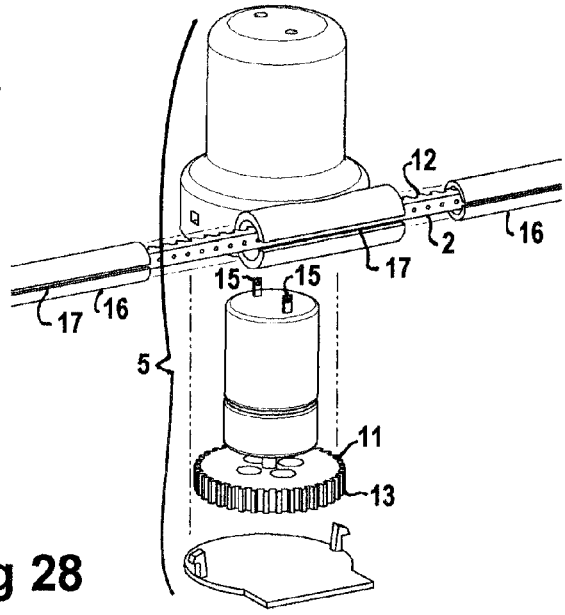
FIG. 28 is an exploded view of a rail with case and drive mechanism.
Figure 29:
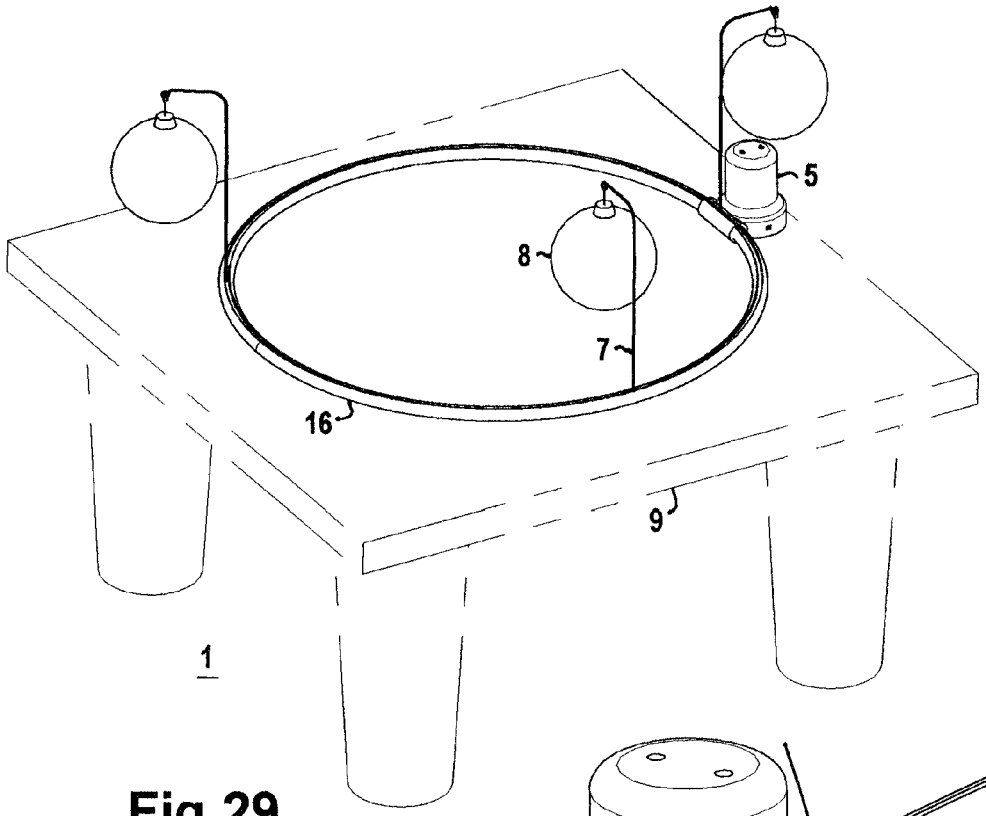
FIG. 29 is a perspective view of moving rail hanger in use mounted on a base shown with broken lines.
Figure 30:
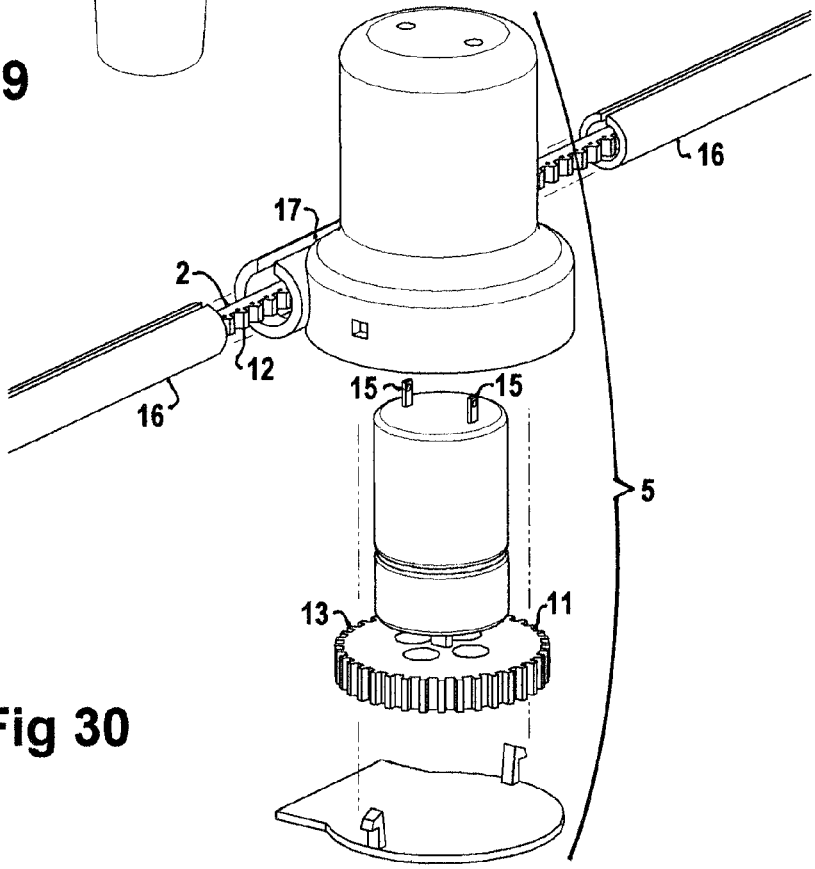
FIG. 30 is an exploded view of a rail with case and drive mechanism.

The moving rail hanger 1 comprises: a) a rail 2; b) a plurality of hanger brackets 3, each of said hanger brackets 3 moveably and detachably attached to said rail 2, and each of said hanger brackets 3 detachably attached to an external support structure 4, at one or more of said hanger brackets 3 further comprising a drive mechanism 5 said drive mechanism 5 said rail 2 along a path of movement 6 defined by said plurality of hanger brackets 3; and c) one or more display brackets 7 immovably and detachably attached to said rail 2.

The moving rail hanger 1 is a device for displaying objects 8, on an external support structure 4, often a decorative item, such as a Christmas Tree, Sports Display, Diorama or other item of interest to observers, where movement of the objects for display 8 relative to the external support structure 4 is desired. The moving rail hanger 1 is placed on the external support structure 4 or on a base 9 shared with the external support structure 4 or a base 9 in close proximity to the external support structure 4. When in operation at least one of the hanger brackets 3 imparts motion to the rail 2 through frictional contact of pinch rollers 10, a gear drive 11, or other suitable means. One implementation of the gear drive 11 is a rack-and-pinion in which the rail 2 forms a rack 12 and a gear in the hanger bracket 3 forms a pinion gear 13. The moving rail 2 supports one or more objects for display 8 by means of the display brackets 7 attached to the rail 2 and thereby causing motion of the objects for display 8 as the rail 2 moves. The moving rail 2 may be constructed of any material which is flexible enough to accommodate movement of the moving rail 2 through the path of movement 6 of the moving rail 2 yet strong enough to support the various display brackets 7 as the rail 2 and display brackets 7 move along the path of movement 6 of a rail 2. Such materials include but are not limited to wood, plastic, and metal. The path of movement 6 is defined by the placement of the hanger brackets 3 and the flexibility of the rail 2. The rail 2 of the moving rail hanger 1 may form a continuous loop. The rail 2 may also not form a continuous loop. The rail 2 may further comprise one or more couplings 18 to couple one or more rail 2 sections to form a longer rail 2. The coupling 18 may be used to connect one or more rail 2 sections into a continuous loop. The coupling 18 may also serve to connect one or more display brackets 7 to the rail 2. The motion of the rail 2 may be forward, or backward, or a combination of forward and backward motion along the path of movement 6 defined by the rail 2 and hanger brackets 3.

The hanger brackets 3 are detachably and moveable attached to the rail 2 to provide support of the rail 2 while permitting movement of the rail 2 relative to the hanger bracket 3. The hanger brackets 3 are permanently or detachably attached to the display item or other external support structure 4. The hanger bracket 3 may be constructed of any material suitable to provide support of the rail 2 while the hanger bracket 3 is attached to, or placed on, the external support structure 4, or base 9. Such materials include but are not limited to wood, plastic, and metal. In one embodiment the hanger bracket 3 may comprise a case 16 which surrounds the rail 2 except for a slot 17 which permits passage of the display bracket 7.

One or more of the hanger brackets 3 includes a drive mechanism 5 to impart motion to the rail 2. The drive mechanism 5 may be pinch rollers 10, gear drives 11, or other means suitable to cause the rail 2 to move. The gear drive 11 may be a rack 12 and pinion gear 13 mechanism wherein the rail 2 is configured to perform as a rack 12 and a gear rotatably attached to the hanger bracket 3 functions as a pinion gear 13.

The hanger brackets 3 may also include decorative elements and sensors 14. Such sensors 14 include, but are not limited to, proximity sensors, light sensors, motion sensors, and weight sensors. The hanger bracket 3 may further comprise logic boards 20 to control sound, light or other desired effects controlled by interaction with one or more sensors 14.

The display brackets 7 are attached to the rail 2 by any suitable means and move with the rail 2. One or more objects for display 8 are attached to the display brackets 7 and move with the display bracket 7 to which the object for display 8 is attached. The display brackets 7 may be constructed of any material suitable to support the attached object for display 8, or objects for display 8, when the display bracket 7 is attached to and moving with the rail 2. Such materials include but are not limited to wood, plastic, and metal.

The display brackets 7 may also include decorative elements and sensors 14. Such sensors include, but are not limited to, proximity sensors, light sensors, motion sensors, and weight sensors. In some embodiments the display bracket 7 may further comprise a shield 19 to keep debris from the internal parts of the display bracket 7 and facilitate movement among obstacles, or both. The display bracket 7 may further comprise logic boards 20 to control the production of sound, light or other desired effects controlled by interaction with one or more sensors 14.

The moving rail hanger 1 may also include sensors 14 between the hanger bracket 3 and the rail 2. The moving rail hanger 1 may include sensors 14 between the rail 2 and one or more display brackets 7. The moving rail hanger 1 may include sensors 14 on the display bracket 7 to provide electrical contact with the objects 8 being displayed. The rail 2 may include one or more electrical conductors 15 to provide an electrical conduction path between one or more hanger brackets 3 and one or more display brackets 7.

It will be appreciated that sensors 14 may interact with objects for display 8 which are not attached to the moving rail hanger 1, and that such static objects 21 may include sensors 14, or logic boards 20, or both sensors 14 and logic boards 20. It will be further appreciated that while electrical communications among hanger brackets 3, display brackets 7, objects for display 8, and the rail 2, is described, pneumatic, optical, or other means of transferring power or information among hanger brackets 3, display brackets 7, objects for display 8, and the rail 2, is within the scope of the invention disclosed herein.

We claim:

1. A moving rail hanger, comprising:

a moving rail;

a plurality of hanger brackets, each of said hanger brackets detachably attached to said rail, and each of said hanger brackets detachably attached to an external support structure, a drive mechanism detachably attached to one or more of the plurality of hanger brackets, said drive mechanism configured to move said rail along a path of movement defined by said plurality of hanger brackets; and one or more display brackets detachably attached to said rail.

2. The moving rail hanger of claim 1 further comprising electrical contacts between at least one of said hanger brackets and said rail.

3. The moving rail hanger of claim 1 further comprising electrical contacts between at least one of said display brackets and said rail.

4. The moving rail hanger of claim 3 further comprising electrical contacts between at least one of said hanger brackets and said rail.

5. The moving rail hanger of claim 1 wherein said rail forms a continuous loop.

6. The moving rail hanger of claim 1 wherein one or more of the drive mechanisms further comprises a pinch roller drive mechanism in communication with the rail and configured to cause the rail to move through the plurality of hanger brackets.

7. The moving rail hanger of claim 1 wherein one or more of the drive mechanism further comprises a rack and pinion assembly in communication with the rail and configured to cause the rail to move through the plurality of hanger brackets.

8. The moving rail hanger of claim 1 wherein at least one of the hanger brackets is attached to the external support structure by placing one or more hanger brackets on said external support structure.

9. The moving rail hanger of claim 1, wherein one or more of the hanger brackets comprises a sensor.

10. The moving rail hanger of claim 9, wherein the sensor is selected from a proximity sensor, a light sensor, a motion sensor, and a weight sensor.

11. The moving rail hanger of claim 1, wherein one or more of the hanger brackets further comprises one or more logic boards.

12. The moving rail hanger of claim 11, wherein the one or more logic boards, independently, controls sound, light, or motion.

13. The moving rail hanger of claim 1, wherein at least one of the hanger brackets or one of the display brackets comprises wood, plastic, metal, or a combination thereof.

14. The moving rail hanger of claim 1, wherein at least one of the display brackets comprises a shield.

15. The moving rail hanger of claim 1 comprising a sensor between the hanger bracket and the rail.

16. The moving rail hanger of claim 1 comprising one or more electrical conductors configured to provide an electrical conduction path between one or more hanger brackets and one or more display brackets.

17. The moving rail hanger of claim 1, wherein the rail is does not form a continuous loop.

18. The moving rail hanger of claim 1, wherein the rail comprises one or more rail sections connected with one or more couplings.

19. The moving rail hanger of claim 18, wherein the couplings comprise electrical contacts.

20. The moving rail hanger of claim 1, wherein power or information is transferred between hanger brackets, display brackets, objects for display, or the rail using pneumatics or optics.

* * * * *